US005116806A

United States Patent [19]

Vanmaele

[11] Patent Number: 5,116,806

[45] Date of Patent: May 26, 1992

[54] DYES FOR USE IN THERMAL DYE TRANSFER

[75] Inventor: Luc J. Vanmaele, Lochristi, Belgium

[73] Assignee: AGFA-Gevaert, N.V., Mortsel, Belgium

[21] Appl. No.: 654,684

[22] Filed: Feb. 13, 1991

[30] Foreign Application Priority Data

Mar. 1, 1990 [EP] European Pat. Off. ..... 90200483

[51] Int. Cl.[5] ..... B41M 5/035; B41M 5/26

[52] U.S. Cl. ..... 503/227; 428/195; 428/480; 428/913; 428/914

[58] Field of Search ..... 8/471; 428/195, 480, 428/913, 914; 503/227

[56] References Cited

U.S. PATENT DOCUMENTS 4,614,521 9/1986 Niwa et al. ..... 8/471

*Primary Examiner*—Bruce H. Hess

*Attorney, Agent, or Firm*—Breiner & Breiner

[57] ABSTRACT

Dye-donor element for use according to thermal dye transfer methods, said element comprising a support having thereon a dye-binder layer comprising a dye corresponding to the general formula:

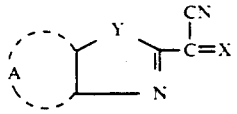

wherein A represents the atoms completing a (hetero)aromatic ring system, which may be substituted or not, Y is O, S, or $NR^1$, X stands for N-Ar, N-Het, N-N=Het, or $CR^2R^3$, $R^1$ is H, (un)substituted alkyl, (un)substituted cycloalkyl, (un)substituted aryl, $-SO_2R^4$, $-COR^4$, $-CSR^4$, or $-POR^4R^5$, Ar is an aromatic nucleus, which is substituted in para-position with amino, alkyloxy, aryloxy, alkylthio, arylthio, which groups may be substituted, or with hydroxy and mercapto, and which aromatic nucleus may also be substituted in other positions with alkyl, aryl, or an acylamido group. Het represents a substituted or unsubstituted heterocyclic ring, $R^2$ and $R^3$ each independently represent H, alkyl, cycloalkyl, aryl, alkenyl, alkynyl, a heterocyclic ring, cyano, a halogen atom, $-SO_2R^4$, $-COR^4$, $-CSR^4$, or $-POR^4R^5$, or $R^2$ and $R^3$ together represent the atoms necessary to complete a substituted or unsubstituted ring system including a substituted or unsubstituted heterocyclic ring system, and $R^4$ and $R^5$ each independently represent alkyl, cycloalkyl, aryl, alkenyl, aralkyl, alkyloxy, aryloxy, alkylthio, arylthio, amino, or a heterocyclic ring, or $R^4$ and $R^5$ together represent the atoms completing a 5- or 6-membered ring system.

12 Claims, No Drawings

DYES FOR USE IN THERMAL DYE TRANSFER

BACKGROUND OF THE INVENTION

1. Field of the Invention

The present invention relates to dye-donor elements for use according to thermal dye sublimation transfer methods and to novel dyes for use in said dye-donor elements.

2. Description of the Prior art

Thermal dye sublimation transfer methods have been developed to make prints from electronic pattern information signals e.g. from pictures that have been generated electronically by means of a colour video camera. To make such prints the electronic picture can be subjected to colour separation with the aid of colour filters. The different colour selections thus obtained can then be converted into electric signals, which can be processed to form cyan, magenta, and yellow electrical signals. The resulting electrical colour signals can then be transmitted to a thermal printer. To make the print a dye-donor element having repeated separate blocks of cyan, magenta, and yellow dye is placed in face-to-face contact with a receiving sheet and the resulting sandwich is inserted between a thermal printing head and a platen roller. The thermal printing head, which is provided with a plurality of juxtaposed heat-generating resistors, can selectively supply heat to the back of the dye-donor element. For that purpose it is heated up sequentially in correspondence with the cyan, magenta, and yellow electrical signals, so that dye from the selectively heated regions of the dye-donor element is transferred to the receiver sheet and forms a pattern thereon, the shape and density of which are in accordance with the pattern and intensity of the heat supplied to the dye-donor element.

A dye-donor element for use according to thermal dye sublimation transfer methods usually comprises a very thin support e.g. a polyester support, which is coated on both sides with an adhesive or subbing layer, one adhesive or subbing layer being covered with a slipping layer that provides a lubricated surface against which the thermal printing head can pass without suffering abrasion, the other adhesive layer at the opposite side of the support being covered with a dye/binder layer, which contains the printing dyes in a form that can be released in varying amounts depending on, as mentioned above, how much heat is applied to the dye-donor element.

The dye/binder layer can be a monochrome dye layer or it may comprise sequential repeated separate blocks of different dyes like e.g. cyan, magenta, and yellow dyes. When a dye-donor element comprising three or more primary colour dyes is used, a multicolour image can be obtained by sequentially performing the dye transfer process steps for each colour.

Any dye can be used in such a dye/binder layer provided it is easily transferable to the dye-image-receiving layer of the receiving sheet by the action of heat.

A great many of dyes are known, which can be used in dye-donor elements for use in thermal dye sublimation transfer methods. Among these are those described in e.g. EP-A 209,990, EP-A 209,991, EP-A 216,483, EP-A 218,397, EP-A 227,095, EP-A 227,096, EP-A 229,374, EP-A 235,939, EP-A 247,737, EP-A 257,577, EP-A 257,580, EP-A 258,856, EP-A 279,330, EP-A 279,467, EP-A 285,665, U.S. Pat. Nos. 4,753,922, 4,753,923, 4,757,046, 4,769,360, 4,771,035, JP 84/78894, JP 84/78895, JP 84/78896, JP 84/227,490, JP 84/227,948, JP 85/27594, JP 85/30391, JP 85/229,787, JP 85/229,789, JP 85/229,790, JP 85/229,791, JP 85/229,792, JP 85/229,793, JP 85/229,795, JP 86/41596, JP 86/268,493, JP 86/268,494, JP 86/268,495, and JP 86/284,489.

Many of the dyes proposed for use in thermal dye sublimation transfer methods do not have a fully satisfying spectral absorption and extinction coefficient or do not give sufficiently high transfer densities.

SUMMARY OF THE INVENTION

It is therefore an object of the present invention to provide a dye-donor element comprising in the dye/binder layer yellow and magenta dyes that have a satisfying spectral absorption and extinction coefficient and that give high transfer densities.

This and other objects are achieved by providing a dye-donor element for use according to thermal dye transfer methods, said element comprising a support having thereon a dye/binder layer comprising a dye carried by a polymeric binder resin, characterized in that said dye corresponds to the following general formula I:

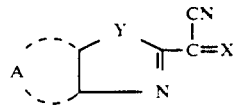

(I)

wherein:

A represents the atoms necessary to complete an aromatic or heteroaromatic ring system, which may be substituted or not, Y stands for O, S, or $NR^1$, X stands for N-Ar, N-Het, N-N=Het, or $C^2R^3$, $R^1$ stands for hydrogen, substituted or unsubstituted alkyl, substituted or unsubstituted cycloalkyl, substituted or unsubstituted aryl, $—SO_2R^4$, $—COR^4$, $—CSR^4$, or $—POR^4R^5$, Ar represents an aromatic nucleus, which is substituted in para-position with a substituent chosen from the group consisting of substituted or unsubstituted amino, substituted or unsubstituted alkyloxy, substituted or unsubstituted aryloxy, substituted or unsubstituted alkylthio, substituted or unsubstituted arylthio, hydroxy, and mercapto, and which aromatic nucleus may also be substituted in other positions with substituted or unsubstituted alkyl, substituted or unsubstituted aryl, or an acylamido group, Het represents a substituted or unsubstituted heterocyclic ring, $R^2$ and $R^3$ each independently represent hydrogen, substituted or unsubstituted alkyl, substituted or unsubstituted cycloalkyl, substituted or unsubstituted aryl, substituted or unsubstituted alkenyl, substituted or unsubstituted alkynyl, a substituted or unsubstituted heterocyclic ring, cyano, a halogen atom, $—SO_2R^4$, $—COR^4$, $—CSR^4$, or $—POR^4R^5$, or $R^2$ and $R^3$ together with the carbon atom to which they are attached represent the atoms necessary to complete a substituted or unsubstituted ring system including a substituted or unsubstituted heterocyclic ring system, and $R^4$ and $R^5$ each independently substituted or unsubstituted alkyl, substituted or unsubstituted cycloalkyl, substituted or unsubstituted aryl, substituted or unsubstituted alkenyl, substituted or unsubstituted aralkyl, substituted or unsubstituted alkyloxy, substituted or unsubstituted aryloxy, substituted or unsubstituted alkylthio, substituted or unsubstituted arylthio, substituted or unsubstituted amino, or a substituted or unsubstituted heterocyclic ring, or $R^4$ and $R^5$ together with the phosphor atom to which they are attached represent the atoms necessary to complete a 5- or 6-membered ring system.

DETAILED DESCRIPTION OF THE INVENTION

The dye-donor element according to the present invention comprises a support, which is preferably coated on both sides with an adhesive layer, one adhesive layer being covered with a slipping layer to prevent the thermal printing head from sticking to the dye-donor element, the other adhesive layer at the opposite side of the support being covered with a dye/binder layer, which contains the printing dyes in differently coloured dye/binder areas in a form that can be released in varying amounts depending on, as mentioned above, how much heat is applied to the dye-donor element, said differently coloured dye/binder areas including dye/binder areas, the dyes of which correspond to the above general formula I.

According to an embodiment of the present invention the dyes, in which X stands for $CR^2R^3$, correspond to the following general formula II:

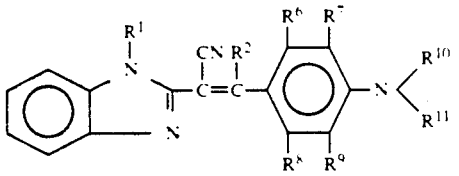

(II)

wherein:

$R^1$ and $R^2$ each have one of the significances given hereinbefore for these symbols, $R^6$, $R^7$, $R^8$, and $R^9$ each independently represent hydrogen, substituted or unsubstituted alkyl, substituted or unsubstituted cycloalkyl, substituted or unsubstituted aryl, substituted or unsubstituted alkyloxy, substituted or unsubstituted aryloxy, substituted or unsubstituted carbamoyl, substituted or unsubstituted sulphamoyl, hydroxy, a halogen atom, —NH—$SO_2$—$R^{12}$, —NH—CO—$R^{12}$, —O—$SO_2$—$R^{12}$, —O—CO—$R^{12}$, $R^{12}$ being as defined for $R^4$ hereinbefore.

$R^{10}$ and $R^{11}$ each independently represent hydrogen, substituted or unsubstituted alkyl, substituted or unsubstituted cycloalkyl, substituted or unsubstituted aryl, a substituted or unsubstituted heterocyclic group, or $R^{10}$ and $R^{11}$ together represent the atoms necessary to complete a substituted or unsubstituted heterocyclic group, or $R^{10}$ and/or $R^{10}$ together with $R^7$ and/or $R^9$ represent the atoms necessary to complete a substituted or unsubstituted heterocyclic group fused on on the benzene ring.

Representative examples of dyes corresponding to general formula II are listed in the following Table 1, the symbols used therein referring to the above formula II.

TABLE 1

| Dye N° | $R^1$ | $R^2$ | $R^6$ | $R^7$ | $R^8$ | $R^9$ | $R^{10}$ | $R^{11}$ |
|---|---|---|---|---|---|---|---|---|
| II.01 | $COOC_2H_5$ | H | H | H | H | H | ethyl | ethyl |
| II.02 | H | H | H | H | H | H | ethyl | ethyl |
| II.03 | $COOC_2H_5$ | CN | H | H | H | H | ethyl | ethyl |
| II.04 | H | H | H | H | H | H | methyl | methyl |
| II.05 | $SO_2CH_3$ | H | H | H | H | H | methyl | methyl |
| II.06 | H | CN | H | H | H | H | methyl | methyl |
| II.07 | $COOC_4H_9$ | H | $OCH_3$ | H | H | H | ethyl | ethyl |
| II.08 | $COOC_4H_9$ | H | $CH_3$ | H | H | H | ethyl | ethyl |

Dyes corresponding to formula II can be synthesized as illustrated by the following preparation examples 1 and 2.

PREPARATION 1: DYE II.04 a) An amount of 162 g (1.5 mol) of o-phenylenediamine and 240 ml (1.5 equivalent) of ethyl cyanoacetate are heated to 150° C. for 2 h with stirring. Ethanol is distilled off under reduced pressure. The mixture is allowed to cool overnight without stirring and then heated again and ethanol is distilled off again. Another 120 ml of ethyl cyanoacetate are added and heating is continued for 4 h at 120° C. The reaction mixture is allowed to cool. The precipitate is filtered and rinsed with dichloromethane, and dried, Yield: 98.5 g of 2-cyanomethyl-benzimidazole.

b) An amount of 10 g (63.7 mmol) of 2-cyanomethyl-benzimidazole is added to 200 ml of ethanol. Next, 9.5 g (1 equivalent) of p-dimethylaminobenzaldehyde is added. Then, 5 drops of piperidine are added. The reaction mixture is refluxed for 8 h, then allowed to cool overnight. The precipitate is filtered off, rinsed with methanol, and dried.

Yield: 7.9 g of dye II.04.

PREPARATION 2: DYE II.06 a) An amount of 1 g (3.5 mmol) of dye 1.04 is added to 10 ml of dimethyl sulphoxide and 0.22 g (1 equivalent) of potassium cyanide is added thereto. The mixture is stirred for 10 min at room temperature, then heated to 50° C. An amount of 0.88 g (1 equivalent) of iodine is added. The mixture is poured out in a mixture of equal volumes of methanol and water. The precipitate is filtered off, rinsed with methanol, and dried.

Yield: 0.3 g of dye II.06.

According to another embodiment of the present invention the dyes, in which X stands for $CR^2R^3$, correspond to the following general formula III:

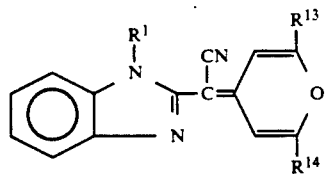

(III)

wherein:

$R^1$ has one of the significances given hereinbefore for that symbol, and $R^{13}$ and $R^{14}$ each independently represent hydrogen, substituted or unsubstituted alkyl, or substituted or unsubstituted aryl.

Representative examples of dyes corresponding to general formula III are listed in the following Table 2, the symbols used therein referring to the above formula III.

TABLE 2

| Dye N° | $R^1$ | $R^{13}$ | $R^{14}$ |
|---|---|---|---|
| III.01 | $COOC_2H_5$ | methyl | methyl |
| III.02 | H | phenyl | phenyl |
| III.03 | H | p-methoxyphenyl | p-methoxyphenyl |

Dyes corresponding to formula III can be synthesized as illustrated by the following preparation example 3.

PREPARATION 3: DYE III.01 a) A mixture of 0.200 g (0.087 mmol or 1 equivalent) of 1-ethoxycarbonyl-2-cyanomethyl-benzimidazole, 0.130 g (104 mmol or 1.2 equivalent) of 2,6-dimethyl-Gamma-pyrone, and 2 ml of acetic anhydride is heated to 120° C. and then allowed to cool. The crystals obtained are filtered off, rinsed first with water and next with methanol. The product is dried.

Yield: 0.100 g of dye III.01 (yellow).

According to a further embodiment of the present invention the dyes, in which X stands for $CR^2R^3$, correspond to the following general formula IV:

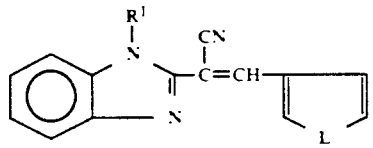

(IV)

wherein:

$R^1$ has one of the significances given hereinbefore for that symbol,

L stands for O, S, or $NR^{15}$, and $R^{15}$ stands for hydrogen, substituted or unsubstituted alkyl, substituted or unsubstituted cycloalkyl, substituted or unsubstituted aryl, $—SO_2R^{16}$, $—COR^{16}$, $—CSR^{16}$, or $—POR^{16}R^{17}$, $R^{16}$ and $R^{17}$ each independently having one of the significances given hereinbefore for $R^4$ and $R^5$.

Representative examples of dyes corresponding to general formula IV are listed in the following Table 3, the symbols used therein referring to the above formula IV.

TABLE 3

| Dye N° | $R^1$ | L | $R^{15}$ |
|---|---|---|---|
| IV.01 | $COOC_2H_5$ | $NR^{15}$ | methyl |
| IV.02 | H | $NR^{15}$ | methyl |
| IV.03 | $COOC_2H_5$ | O | — |
| IV.04 | H | S | — |
| IV.05 | $COOC_4H_9$ | $NR^{15}$ | methyl |
| IV.06 | $COOC_4H_9$ | $NR^{15}$ | H |
| IV.07 | $SO_2CH_3$ | $NR^{15}$ | methyl |

Dyes corresponding to formula IV can be synthesized as illustrated by the following preparation example 4.

PREPARATION 4: DYE IV.02 a) A mixture of 0.200 g (0.087 mmol or 1 equivalent) or 1-ethoxycarbonyl-2-cyanomethyl-benzimidazole, 0.094 g (1 equivalent) of 1-methyl-pyrrole-2-aldehyde, 2 ml of ethanol, and 1 drop of piperdine is refluxed for 24 h and then allowed to cool. The crystals obtained are filtered off.

Yield: 170 mg of dye IV.02 (yellow).

The dyes according to the present invention in which X stands for N-Ar, can be represented by the following general formula V:

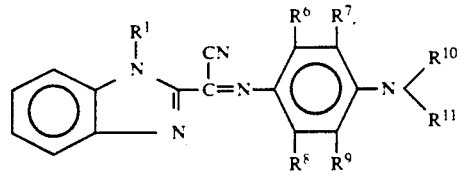

(V)

wherein:

$R^1$ has one of the significances given hereinbefore for that symbol, $R^6$, $R^7$, $R^8$, $R^9$, $R^{10}$, and $R^{11}$ each have one of the significances given for these symbols under general formula II.

Representative examples of dyes corresponding to general formula V are listed in the following Table 4, the symbols used therein referring to the above formula V.

TABLE 4

| Dye N° | $R^1$ | $R^6$ | $R^7$ | $R^8$ | $R^9$ | $R^{10}$ | $R^{11}$ |
|---|---|---|---|---|---|---|---|
| V.01 | $COOC_2H_5$ | H | H | H | H | ethyl | ethyl |
| V.02 | H | H | H | H | H | ethyl | ethyl |
| V.03 | H | methyl | H | H | H | ethyl | ethyl |
| V.04 | $SO_2CH_3$ | H | H | H | H | ethyl | ethyl |
| V.05 | $SO_2CH_3$ | methyl | H | H | H | ethyl | ethyl |
| V.06 | $CO—C_6H_5$ | H | H | H | H | ethyl | ethyl |
| V.07 | $CO—C_6H_5$ | methyl | H | H | H | ethyl | ethyl |
| V.08 | $COOC_2H_5$ | methyl | H | H | H | ethyl | ethyl |
| V.09 | H | $NHCOCH_3$ | H | H | H | ethyl | ethyl |
| V.10 | H | NHCO-t-butyl | H | H | H | ethyl | ethyl |
| V.11 | $CO—C_6H_5$ | $NHCOCH_3$ | H | H | H | ethyl | ethyl |
| V.12 | $COOC_2H_5$ | NHCO-t-butyl | H | H | H | ethyl | ethyl |
| V.13 | $CO—CH_3$ | $NHCOCH_3$ | H | H | H | ethyl | ethyl |
| V.14 | $SO_2CH_3$ | NHCO-t-butyl | H | H | H | ethyl | ethyl |
| V.15 | CO-iso-$C_3H_7$ | NHCO-t-butyl | H | H | H | ethyl | ethyl |
| V.16 | $CO—C_7H_{15}$ | NHCO-t-butyl | H | H | H | ethyl | ethyl |
| V.17 | H | $NHCO—C_5H_{11}$ | H | H | H | ethyl | ethyl |
| V.18 | $CO—C_6H_5$ | $NHCO—C_5H_{11}$ | H | H | H | ethyl | ethyl |
| V.19 | H | NHCO-iso-$C_3H_7$ | H | H | H | ethyl | ethyl |
| V.20 | CO-iso-$C_3H_7$ | $NHCOCH_3$ | H | H | H | ethyl | ethyl |
| V.21 | CO-iso-$C_3H_7$ | NHCO-iso-$C_3H_7$ | H | H | H | ethyl | ethyl |
| V.22 | $COOC_2H_5$ | NHCO-iso-$C_3H_7$ | H | H | H | ethyl | ethyl |
| V.23 | $COOC_2H_5$ | $NHCO—C_5H_{11}$ | H | H | H | ethyl | ethyl |
| V.24 | $CO—CH_3$ | $NHCO—C_5H_{11}$ | H | H | H | ethyl | ethyl |
| V.25 | $CO—C_7H_{15}$ | $NHCO—CH_3$ | H | H | H | ethyl | ethyl |
| V.26 | $CO—C_7H_{15}$ | NHCO-iso-$C_3H_7$ | H | H | H | ethyl | ethyl |
| V.27 | H | $NHCOO—C_4H_9$ | H | H | H | ethyl | ethyl |

Dyes corresponding to formula V can be synthesized as illustrated by the following preparation examples.

PREPARATION 5: DYE V.02

An amount of 10 g (63.7 mmol) of 2-cyanomethyl-benzimidazole is dissolved in 80 ml of methanol and 14.0 g (1.1 equivalent) of N,N-diethyl-p-phenylenediamine monohydrochloride. A solution of 33 g of sodium carbonate in 50 ml of water is added. A solution of 32.3 g of iodine in 100 ml of methanol is added dropwise. The reaction mixture is stirred for 20 min at room temperature. The precipitate is filtered off, rinsed until neutral, and dried.

The product is dissolved in 250 ml of methanol, filtered, and allowed to crystallize.

Yield: 5.6 g of dye V.02 melting at 234° C.

PREPARATION 6: DYE V.03

Dye V.03 is prepared in an analogous way as described for dye V.02 by using 2-amino-5-dimethylamino-toluene hydrochloride instead of the N,N-diethyl-p-phenylenediamine monohydrochloride.

PREPARATION 7: DYE V.04

An amount of 2.0 g (6.3 mmol) of dye V.02 is added to 10 ml of methylene chloride. One equivalent (0.5 ml) of pyridine is added thereto. A volume of 0.49 ml (1 equivalent) of methanesulphonyl chloride is added dropwise. The reaction mixture is stirred at room temperature. Another 1.5 ml (3 equivalents) of pyridine and 1.5 ml (3 equivalents) of methanesulphonyl chloride are added. The reaction mixture is stirred for 3 h at room temperature. Next, 0.9 ml (1 equivalent) of triethylamine is added. The reaction product is extracted with equal volumes of ethyl acetate and 1N hydrochloric acid. The ethyl acetate phase is rinsed with water. A precipitate starts forming. Methanol is added so that even more precipitate forms. The precipitate is filtered, rinsed with water, and dried.

Yield: 1.5 g of dye V.04 melting at 182° C.

PREPARATION 8: DYE V.05

Dye V.05 is prepared in an analogous way as described for dye V.04 by using dye V.03 instead of dyeV.02.

PREPARATION 9: DYE V.06

An amount of 2.0 g (6.3 mmol) of dye V.02 is dissolved in 20 ml of methylene chloride. An amount of 3.5 ml (4 equivalents) of triethylamine is added and 2.9 ml of benzoyl chloride is added dropwise at room temperature. The reaction mixture is stirred at room temperature for 1 h and then poured out in 100 ml of methanol. The precipitate is filtered, rinsed with water, and dried.

Yield: 2.0 g of dye V.06 melting at 164° C.

PREPARATION 10: DYE V.07

Dye V.07 is prepared in an analogous way as described for dye V.06 by using dye V.03 instead of dye V.02.

PREPARATION 11: DYE V.08

An amount of 2.0 g (6 mmol) of dye V.03 is dissolved in 20 ml of methylene chloride. An amount of 3.4 ml (4 equivalents) of triethylamine is added. The mixture is cooled at 0° C. Slowly, 2.3 ml of ethyl chloroformate is added. The reaction mixture is stirred at room temperature and allowed to stand overnight. The product is extracted with equal volumes of ethyl acetate and water. The organic phase is rinsed with a saturated sodium chloride solution and dried over sodium sulphate. Next, the organic phase is concentrated by evaporation. The residue is recrytallized from 50 ml of methanol. The precipitate is filtered, rinsed with methanol, and recrystallized from methanol (20 ml). The precipitate is filtered, rinsed with methanol, and dried.

Yield: 0.8 g of dye V.08 melting at 130° C.

PREPARATION 12: DYE V.09

An amount of 4.0 g (25.5 mmol) of 2-cyanomethylbenzimidazole is dissolved in 40 ml of ethanol and 6.9 g (1.0 equivalent) of 3-acetylamino-4-nitroso-N,N-diethyl-aniline monohydrochloride and 3.75 ml (1.05 equivalent) of triethylamine are added to the solution. The reaction mixture is stirred for 24 h at room temperature. The product is extracted with equal volumes of ethyl acetate and 1N hydrochloric acid. The organic layer is rinsed first with water and next with a saturated sodium chloride solution. The solution is dried and concentrated by evaporation. Finally, the residue is purified by crystallization from acetonitrile.

Yield: 4.0 g of dye V.09.

PREPARATION 13: DYE V.10 a) An amount of 34.6 g (0.14 mol) of 2-pivalamido-N,N-diethyl-aniline, 85 ml of water, and 85 ml of concentrated hydrochloric acid is stirred until complete dissolution. The solution is cooled on an icebath. A solution of 10.5 g (1.1 equivalent) of sodium nitrite in 30 ml of water is added dropwise. The reaction mixture turns deepbrown. It is stirred for 20 min at 15°–20° C. and then poured out in 200 ml of concentrated ammonium hydroxide. The product is extracted with ethyl acetate. The organic layer is rinsed with water until neutral, rinsed with a concentrated sodium chloride solution, dried over sodium sulphate, and concentrated by evaporation.

Yield: 29.5 g of 3-pivalamido-4-nitroso-N,N-diethyl-aniline.

b) An amount of 2.0 g (12.7 mmol) of 2-cyanomethylbenzimidazole is dissolved in 20 ml of ethanol. An amount of 3.5 g (1.0 equivalent) of 3-pivalamido-4-nitroso-N,N-diethyl-aniline and of 1.78 ml (1 equivalent) of triethylamine is added to the solution. The reaction mixture is stirred for 24 h at room temperature. The product is poured out in ethyl acetate and the ethyl acetate solution is rinsed twice with 50 ml of 1N hydrochloric acid. The solution is rinsed first with water and next with a saturated sodium chloride solution, then dried, and concentrated by evaporation. The residue is dissolved in 25 ml of acetonitrile. The solution is refluxed, filtered while hot and allowed to crystallize. The crystals are filtered off, rinsed with acetonitrile, and dried.

Yield: 1.0 g of dye V.10 melting at 244° C.

PREPARATION 14: DYE V.11

An amount of 1.0 g (2.67 mmol) of dye V.09 is dissolved in 10 ml of dry dichloromethane and 1.5 ml (4 equivalents) of triethylamine. Slowly, 1.24 ml (4 equivalents) of benzoyl chloride at 8° C. is added. The reaction mixture is cooled on an icebath. It is stirred for 17 h at 22° C. under a calcium chloride drying tube. The reaction mixture is diluted with ethyl acetate, rinsed until neutral with water, rinsed with a saturated sodium chloride solution, dried over sodium sulphate, and concentrated by evaporation. The product is boiled up in 20 ml of methanol and allowed to cool. The precipitate is filtered off, rinsed with water, and dried.

Yield: 0.8 g of dye V.11 melting at 200° C.

PREPARATION 15: DYE V.12

Dye V.12 is prepared in an analogous way as described for dye V.08, but by using dye V.10 instead of dye V.03.

PREPARATION 16: DYE V.13

Dye V.13 is prepared in an analogous way as described for dye V.11, but by using acetyl chloride instead of benzoyl chloride.

PREPARATION 17: DYE V.14

An amount of 1.0 g (2.4 mmol) of dye V.10 is dissolved in 10 ml of dichloromethane and 0.49 ml (2.5 equivalents) of pyridine. A volume of 0.47 ml (2.5 equivalents) of methanesulphonyl chloride is added dropwise at room temperature. After the addition has been completed, the mixture is refluxed. After 1 h of reflux 0.49 ml of pyridine and 0.47 ml of methanesulphonyl chloride is added again. Refluxing is continued for 3 h. The reaction mixture is allowed to stand for 90 h at room temperature under nitrogen atmosphere. Another amount of 0.49 ml of pyridine and 0.47 ml of methanesulphonyl chloride is added. The reaction mixture is refluxed for 4 h. The reaction product is concentrated by evaporation, refluxed in methanol, allowed to crystallize, filtered, rinsed with water, and dried.

Yield: 0.5 g of dye V.14 melting at 170° C.

PREPARATION 18: DYE V.15

An amount of 1.0 g (2.4 mmol) of dye V.10 is dissolved in 10 ml of dichloromethane and 0.2 ml (1 equivalent) of pyridine. A volume of 0.25 ml (1 equivalent) of isobutyryl chloride is added dropwise at room temperature in 1 h. Another amount of 0.2 ml (1 equivalent) of pyridine and 0.25 ml (1 equivalent) of isobutyryl chloride is is added. The reaction mixture is stirred for 1 h. Again, 0.38 ml (1.5 equivalent) of isobutyryl chloride and 0.2 ml of pyridine are added. The reaction mixture is poured out in 100 ml of methanol and stirred. The precipitate is filtered off, rinsed with ethanol, and dried.

Yield: 0.70 g of dye V.15 melting at 150° C.

PREPARATION 19: DYE V.16

A mixture of 1.0 g (2.4 mmol) of dye V.10, 10 ml of methylene chloride, and 1.4 ml (4 equivalents) of triethylamine is cooled on an icebath. A volume of 1.6 ml (4 equivalents) of octanoyl chloride is added dropwise. The reaction mixture is stirred at room temperature. After 10 min the reaction has come to an end. The reaction product is extracted with equal volumes of ethyl acetate and 1N hydrochloric acid. The organic phase is rinsed until neutral with water, dried, concentrated by evaporation, and dried under reduced pressure. The residue is dissolved in 9 ml of methanol, filtered while hot, and allowed to crystallize. The crystals are filtered and rinsed with methanol.

Yield: 0.65 g of dye V.16 melting at 95° C.

PREPARATION 20: DYE V.17

An amount of 5.3 g (33.6 mmol) of 2-cyanomethylbenzimidazole is dissolved in 60 ml of ethanol. An amount of 11 g (1.0 equivalent) of 3-hexanamido-4-nitroso-N,N-diethyl-aniline monohydrochloride and of 3.57 ml (1.05 equivalent) of piperidine are added to the solution. The reaction mixture is stirred for 24 h at room temperature. The reaction product is extracted with equal volumes of dichloromethane and 1N hydrochloric acid. The organic phase is rinsed until neutral with water, dried over sodium sulphate, and concentrated by evaporation. The residue is purified by crystallization.

Yield: 3.5 g of dye V.17.

PREPARATION 21: DYE V.18

A mixture of 1.0 g (2.3 mmol) of dye V.17, 5 ml of methylene chloride, 0.4 ml (2.1 equivalent) of pyridine, and 0.57 ml (2.1 equivalent) of benzoyl chloride is stirred for 3 h at room temperature. The reaction product is extracted with equal volumes of ethyl acetate and 1N hydrochloric acid. The organic phase is rinsed until neutral with water, dried, and concentrated by evaporation. The residue is purified by column chromatography with dichloromethane as an eluent.

Yield: 0.22 g of dye V.18 melting at 184° C.

PREPARATION 22: DYE V.19

Dye V.19 (melting at 250° C.) is prepared in an analogous way as described for dye V.10, but by using 3-isobutyramido-4-nitroso-N,N-diethyl-aniline instead of 3-pivalamido-4-nitroso-N,N-diethyl-aniline.

PREPARATION 23: DYE V.20

Dye V.20 (melting at 190° C.) is prepared in an analogous way as described for dye V.15, but by using dye V.09 instead of dye V.10.

PREPARATION 24: DYE V.21

Dye V.21 is prepared in an analogous was as described for dye V.15, but by using dye V.19 instead of dye V.10.

PREPARATION 25: DYE V.22

Dye V.22 (melting at 130° C.) is prepared in an analogous way as described for dye V.12, but by using dye V.19 instead of dye V.10.

PREPARATION 26: DYE V.23

Dye V.23 (melting at 114° C.) is prepared in an analogous way as described for dye V.12, but by using dye V.17 instead of dye V.10 and pyridine instead of triethylamine.

PREPARATION 27: DYE V.24

An amount of 1.0 (2.3 mmol) of dye V.17 is dissolved in 5 ml of dichloromethane and 0.4 ml (2.1 equivalent) of pyridine. A volume of 0.35 ml (2.1 equivalent) of acetyl chloride is added dropwise and the solution is stirred for 1 h at room temperature. A volume of 20 ml of methanol is added to the solution and the product is allowed to crystallize. The crystals are filtered and purified by column chromatography (eluent: dichloromethane).

Yield: 0.53 g of dye V.24.

PREPARATION 28: DYE V.25

Dye V.25 is prepared in an analogous way as described for dye V.20, but by using octanoyl chloride instead of isobutyryl chloride.

PREPARATION 29: DYE V.26

Dye V.26 is prepared in an analogous way as described for dye V.21, but by using octanoyl chloride instead of isobutyryl chloride.

PREPARATION 30: DYE V.27 a) An amount of 13.0 g (49 mmol) of 3-n-butoxycarbonylamino-N,N-diethylaniline in 16 ml of water is stirred vigorously at 5° C. A volume of 29.5 ml of concentrated hydrochloric acid is added. The reaction mixture is stirred at 10° C. Slowly, 3.8 g of sodium nitrite in 10.5 ml of water is added. When the reaction has ended, the reaction mixture is poured out in 250 ml of ethyl acetate and neutralized with an ammoniacal solution. The organic layer is rinsed with water, dried, and concentrated by evaporation.

Yield: 10.5 g of 3-n-butoxycarbonylamino-4-nitroso-N,N-diethyl-aniline b) An amount of 5.5 g (35 mmol) of 2-cyanomethyl-benzimidazole is dissolved in 50 ml of ethanol. An amount of 10.3 g (1.0 equivalent) of 3-n-butoxycarbonylamino-4-nitroso-N,N-diethyl-aniline and of 5 drops of piperidine are added to the solution. The reaction mixture is refluxed for 4 h and then allowed to cool. The product is extracted with dichloromethane and rinsed with water. The solution is dried over sodium sulphate, filtered, and concentrated under reduced pressure. The residue is purified by column chromatography.

Yield: 10 g of dye V.27 melting at 225° C.

The dyes according to the present invention in which X stands for N-Het, Het being a heterocyclic nucleus, can be represented by the following general formula VI:

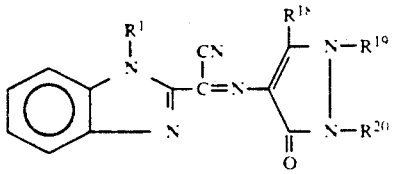

(VI)

$R^1$ has one of the significances given hereinbefore for that symbol, $R^{18}$ represents hydrogen or any substituent e.g. substituted or unsubstituted alkyl, substituted or unsubstituted cycloalkyl, substituted or unsubstituted aryl, carboxylic ester, carboxylic amide, amino, and acylamino, $R^{19}$ represents hydrogen, substituted or unsubstituted alkyl, substituted or unsubstituted cycloalkyl, substituted or unsubstituted aryl, or a heterocyclic residue, $R^{20}$ represents hydrogen, substituted or unsubstituted alkyl, substituted or unsubstituted cycloalkyl, substituted or unsubstituted aryl, acyl, or a heterocyclic residue.

Representative examples of dyes corresponding to general formula VI are listed in the following Table 5, the symbols used therein referring to the above formula VI.

TABLE 5

| Dye N° | $R^1$ | $R^{18}$ | $R^{19}$ | $R^{20}$ |
|---|---|---|---|---|
| VI.01 | H | methyl | methyl | phenyl |
| VI.02 | $COOC_2H_5$ | methyl | methyl | phenyl |
| VI.03 | $COOC_2H_5$ | tridecyl | methyl | methyl |
| VI.04 | $SO_2CH_3$ | methyl | methyl | phenyl |
| VI.05 | $COOC_4H_9$ | methyl | methyl | phenyl |

Dyes corresponding to formula VI can be synthesized as illustrated by the following preparation example.

PREPARATION 31: DYE VI.01 a) A solution of 0.9 g of sodium carbonate in 6 ml of water is added to a mixture of 0.5 g (22 mmol) of 1-ethoxycarbonyl-2-cyanomethyl-benzimidazole, 0.044 g (1.1 equivalent) of 1-phenyl-2,3-dimethyl-4-amino-pyrazoline-5-one, and 10 ml of methanol. A solution of 0.55 g (1 equivalent) of iodine in 6 ml of methanol is added dropwise to the mixture. A volume of 40 ml of water is added. The reaction product is filtered off, rinsed with water, and dried at 50° C.

Yield: 0.200 mg of dye VI.01 (yellow).

The dyes according to the present invention in which X stands for N-N=Het, Het being a heterocyclic nucleus, can be represented by the following general formula VII:

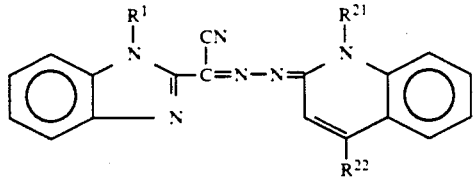

(VII)

$R^1$ has one of the significance given hereinbefore for that symbol, $R^{21}$ represents hydrogen, substituted or unsubstituted alkyl, substituted or unsubstituted cycloalkyl, substituted or unsubstituted aryl, or a heterocyclic residue, $R^{22}$ represents hydrogen or any substituent e.g. substituted or unsubstituted alkyl, substituted or unsubstituted cycloalkyl, substituted or unsubstituted aryl.

Representative examples of dyes corresponding to general formula VII are listed in the following Table 6, the symbols used therein referring to the above formula VII.

TABLE 6

| Dye N° | $R^1$ | $R^{21}$ | $R^{22}$ |
|---|---|---|---|
| VII.01 | H | phenyl | methyl |
| VII.02 | $COOC_2H_5$ | phenyl | methyl |
| VII.03 | $SO_2CH_3$ | phenyl | methyl |

Dyes corresponding to formula VII can be synthesized as illustrated by the following preparation example.

PREPARATION 32: DYE VII.01 a) A mixture of 0.200 g (0.87 mmol or 1 equivalent) of 1-ethoxycarbonyl-2-cyanomethyl-benzimidazole, 0.470 g (1 equivalent) of 1-phenyl-2-n-hexadecylsulphonylhydrazono-4-methyl-quinoline, and 5 ml of methanol is stirred at room temperature. A solution of 0.28 g (3 equivalents) of sodium carbonate in 1 ml of water is added dropwise to the mixture. A solution of 0.22 g (1 equivalent) of iodine in 2.5 ml of methanol is added dropwise to the mixture. Stirring of the reaction mixture is continued for 15 min. The reaction product is filtered off, rinsed with water, and dried at 50° C.

Yield: 0.310 g of dye VII.01 (yellow).

The dyes according to the present invention in which X stands for N-N=Het, Het being a heterocyclic nucleus, can be represented also by the following general formula VIII:

(VIII)

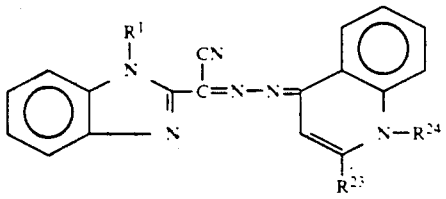

$R^1$ has one of the significances given hereinbefore for that symbol, $R^{23}$ has one of the significances given hereinbefore for $R^{22}$, and $R^{24}$ has one of the significances given hereinbefore for $R^{21}$.

Representative examples of dyes corresponding to general formula VIII are listed in the following Table 7, the symbols used therein referring to the above formula VIII.

TABLE 7

| Dye N° | $R^1$ | $R^{23}$ | $R^{24}$ |
|---|---|---|---|
| VIII 01 | H | phenyl | methyl |
| VIII 02 | $COOC_2H_5$ | phenyl | methyl |
| VIII 03 | $SO_2CH_3$ | phenyl | methyl |

Dyes corresponding to formula VIII can be synthesized analogously as described for the dyes corresponding to general formula VII.

The dyes of the present invention have a yellow or magenta hye.

The dyes of the present invention can be used in any thermal dye transfer method according to which printing dyes can be released by fusion, vapourization, or sublimation. They can be used in inks e.g. for laser applications and for inkjet. They can further be employed in a layer making part of a photographic material comprising at least one light-sensitive silver halide emulsion layer or in non-photographic materials such as in textile, varnishes, lacquers, paints, synthetic materials, and in glass. They can also find an application in resistive ribbon printing processes. A survey of resistive ribbon printing has been given in J. Imaging Technology, Vol. 12, No. 2, April 1986, page 100-110. A resistive sublimation ribbon that can be used in combination with the dyes used according to the present invention has been described in the Research Disclosure 29442 (October 1988) page 769.

According to the most important embodiment of the present invention the dyes are used in the dye/binder layer of a dye-donor element for thermal dye sublimation transfer.

The dye/binder layer of a dye-donor element for thermal dye sublimation transfer is formed preferably by adding the dyes, the binder resin, and other optional components to a suitable solvent or solvent mixture, dissolving or dispersing the ingredients to form a composition that is applied to a support, which may have been provided first with an adhesive layer, and dried.

The dye/binder layer thus formed has a thickness of about 0.2 to 5.0 μm, preferably 0.4 to 2.0 μm, and the amount ratio of dye to binder is from 9:1 to 1:3 by weight, preferably from 2:1 to 1:2 by weight.

The binder resin can be chosen from cellulose derivatives like ethyl cellulose, hydroxyethyl cellulose, ethylhydroxy cellulose, ethylhydroxyethyl cellulose, hydroxypropyl cellulose, methyl cellulose, cellulose acetate, cellulose acetate formate, cellulose acetate propionate, cellulose acetate butyrate, cellulose acetate pentanoate, cellulose acetate hexanoate, cellulose acetate heptanoate, cellulose acetate benzoate, cellulose acetate hydrogen phthalate, cellulose triacetate, and cellulose nitrate; vinyl-type resins like polyvinyl alcohol, polyvinyl acetate, polyvinyl butyral, polyvinyl pyrrolidone, polyvinyl acetoacetal, and polyacrylamide; polymers and copolymers derived from acrylates and acrylate derivatives, such as polyacrylic acid, polymethyl methacrylate, and styrene-acrylate copolymers; polyester resins; polycarbonates; poly(styrene-co-acrylonitrile); polysulfones; polyphenylene oxide; organosilicones such as polysiloxanes; epoxy resins and natural resins, such as gum arabic.

The binder resin can be added to the dye/binder layer in widely varying concentrations. In general, good results are obtained with 0.1 to 5 g of binder resin per m2 of coated support.

The dye/binder layer comprises from 0.05 to 1 g of dye per mIII.

The dye/binder layer can also comprise other components such as e.g. curing agents, preservatives, and other ingredients, which have been described exhaustively in EP-A 0,133,011, EP-A 0,133,012, EP-A 0,111,004, and EP-A 0,279,467.

Any material can be used as the support for the dye-donor element provided it is dimensionally stable and capable of withstanding the temperatures involved, i.e. up to 400° C. over a period of up to 20 msec, and is yet thin enough to transmit heat supplied to one side through to the dye on the other side to effect transfer to the receiver sheet within such short periods, typically from 1 to 10 msec. Such materials include polyesters such as polyethylene therephthalate, polyamides, polyacrylates, polycarbonates, cellulose esters, fluorinated polymers, polyethers, polyacetals, polyolefins, polyimides, glassine paper, and condenser paper. Preference is given to a support comprising polyethylene terephthalate. In general, the support has a thickness of 2 to 30 μm. If desired, the support can be coated with an adhesive or subbing layer.

The dye/binder layer of the dye/donor element can be applied to the support by coating or by printing techniques such as a gravure process.

A dye barrier layer comprising a hydrophilic polymer can be provided between the support and the dye/binder layer of the dye-donor element to improve the dye transfer densities by preventing wrong-way transfer of dye into the support. The dye barrier layer may contain any hydrophilic material that is useful for the intended purpose. In general, good results have been obtained with gelatin, polyacrylamide, polyisopropyl acrylamide, butyl methyacrylate-grafted gelatin, ethyl methacylate-grafted gelatin, ethyl acrylate-grafted gelatin, cellulose monoacetate, methylcellulose, polyvinyl alcohol, polyethylene imine, polyacrylic acid, a mixture of polyvinyl alcohol and polyvinyl acetate, a mixture of polyvinyl alcohol and polyacrylic acid, or a mixture of cellulose monoacetate and polyacrylic acid. Suitable dye barrier layers have been described in e.g. EP-A 0.227,091 and EP-A 0,228,065. Certain hydrophilic polymers e.g. those described in EP-A 0.227,091 also have an adequate adhesion to the support and the dye/binder layer, thus eliminating the need for a separate adhesive or subbing layer. These particular hydrophilic polymers used in one single layer in the dye-donor element thus perform a dual function, hence are referred to as dye barrier/subbing layers.

Preferably the reverse side of the dye-donor element can be coated with a slipping layer to prevent the printing head from sticking to the dye-donor element. Such a slipping layer would comprise a lubricating material such as a surface-active agent, a liquid lubricant, a solid lubricant, or mixtures thereof, with or without a polymeric binder. The surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, and fluoroalkyl $C_2$–$C_{20}$ aliphatic acid. Examples of liquid lubricants include silicone oils, synthetic oils, saturated hydrocarbons, and glycols. Examples of solid lubricants include various higher alcohols such as stearyl alcohol, fatty acids and fatty acid esters. Suitable slipping layers have been described in e.g. EP-A 0,138,483, EP-A 0,227,090, U.S. Pat. Nos. 4,567,113, 4,572,860, and 4,717,711.

The dye-donor element can be used in sheet form or in the form of a continuous roll or ribbon.

The support of the receiver sheet to be used in combination with the dye-donor element may be transparent film of e.g. polyethylene terephthalate, a polyether sulfone, a polyimide, a cellulose ester, and a polyvinyl alcohol-coacetal. The support may also be a reflecting one such as e.g. baryta-coated paper, polyethylene-coated paper, and white polyester i.e. white-pigmented polyester.

To avoid poor adsorption of the transferred dye to the support of the receiver sheet, this support must be coated with a special surface, generally known as dye-image-receiving layer, into which the dye can diffuse more readily. The dye image-receiving layer may comprise e.g. a polycarbonate, a polyurethane, a polyester, a polyamide, polyvinyl chloride, polystyrene-coacrylonitrile, polycaprolactone, and mixtures thereof. Suitable dye-image-receiving layers have been described in e.g. EP-A 0,133,011, EP-A 0,133,012, EP-A 0,144,247, EP-A 0,227,094, and EP-A 0,228,066.

UV-absorbers and/or antioxidants may be incorporated into the dye-image-receiving layer for improving the fastness to light and other stabilities of the recorded images.

It is generally known to use a releasing agent that aids in separating the receiver sheet from the dye-donor element after transfer. Solid waxes, fluorine- or phosphate-containing surfactants, and silicone oils can be used as releasing agent. A suitable releasing agent has been described in e.g. EP-A 0,133,012, JP 85/19138, and EP-A 0,227,09III.

The dye-donor elements according to the present invention are used to form a dye transfer image. Such a process comprises placing the dye layer of the dye-donor element in face-to-face relation with the dye-receiving layer of the receiver sheet and image-wise heating from the back of the donor element. The transfer of the dye is accomplished by heating for milliseconds at a temperature that may be as high as 400° C.

When the dye transfer is performed for but one single colour, a monochrome yellow or magenta dye transfer image is obtained, which consists of at least one dye according to the present invention. A multicolour image can be obtained by using a dye-donor element containing three or more primary colour dyes, one of which may consist of at least one yellow dye according to the present invention, another one of which may consist of at least one magenta dye according to the present invention, and sequentially performing the process steps described above for each colour. The above sandwich of dye-donor element and receiver sheet is then formed on three or more occasions during the time heat is being supplied by the thermal printing head. After the first dye has been transferred, the elements are peeled apart. A second dye-donor element or another area of the dye-donor element with a different dye area is then brought in register with the receiver sheet and the process is repeated. The third colour and optionally further colours are obtained in the same manner.

In addition to thermal printing heads, laser lights, infrared flash, or heated pins can be used as a heat source for supplying the heat energy. Thermal printing heads that can be used to transfer dye from the dye-donor elements of the present invention to a receiver sheet are commercially available. Suitable thermal printing heads are e.g. a Fujitsu Thermal Head (FTP-040 MCS001), a TDK Thermal Head F415 HH7-1089, and a Rohm Thermal Head KE 2008-F3.

The following examples illustrate the present invention without limiting, however, the scope thereof.

EXAMPLE 1

The absorption maxima (λmax) and molar extinction coefficients (ε) of the dyes identified hereinafter were determined to methanol. The results are listed in Table 8.

TABLE 8

| Dye | λmax (nm) | ε ($mol^{-1}$ $cm^{-1}$/l) |
|---|---|---|
| II.02 | 433 | 59597 |
| II.04 | 426 | 40264 |
| IV.02 | 393 | 27122 |
| V.01 | 490 | 32691 |
| V.02 | 495 | 50845 |
| V.03 | 507 | 41686 |
| V.04 | 494 | 41896 |
| V.05 | 508 | 24789 |
| V.06 | 508 | 52996 |
| V.07 | 521 | 46197 |
| V.08 | 500 | 36650 |
| V.09 | 521 | 51363 |
| V.10 | 524 | 48160 |
| V.11 | 527 | 34689 |
| V.12 | 501 | 40461 |
| V.13 | 520 | 56181 |
| V.14 | 500 | 39152 |
| V.15 | 525 | 48023 |
| V.16 | 525 | 48672 |
| V.17 | 522 | 58996 |
| V.18 | 531 | 53400 |
| V.19 | 522 | 50018 |
| V.20 | 529 | 53976 |
| V.21 | 530 | 53902 |
| V.22 | 508 | 43311 |
| V.23 | 509 | 42347 |
| V.24 | 522 | 52203 |

EXAMPLE 2

A dye-donor element for use according to thermal dye sublimation transfer were prepared as follows.

To avoid sticking of the dye-donor element to the thermal printing head the rear side of a 5 μm polyethylene terephthalate support was provided first with a solution for forming a slipping layer, said solution comprising 10 g of co(styrene/acrylonitrile) comprising 104 styrene units and 53 acrylonitrile units, which copolymer is sold under the trade mark LURAN 378 P by BASF AG, D-6700 Ludwigshafen, West Germany, 10 g of a 1% solution of polysiloxane polyether copolymer sold under the trade mark TEGOGLIDE 410 by TH. GOLDSCHMIDT AG, D-4300 Essen 1, Goldschmidtstrasse 100, West Germany, and sufficient ethyl methyl ketone solvent to adjust the weight of the solution to a total of 100 g. From this solution a layer having a wet thickness of 15 μm was printed by means of a gravure press. The resulting layer was dried by evaporation of the solvent.

An amount of dye as identified in Table 5 hereinafter and a binder resin in an amount, both as defined in the same Table 5, were dissolved in 10 ml of ethyl methyl ketone. The resulting ink-like composition was coated by means of a doctor knife on the front side of the polyethylene terephthalate support at a wet layer thickness of 100 μm and dried.

A commercially available Hitachi material (VY-S100A-paper ink set) was used as receiver sheet.

The dye-donor element was printed in combination with the receiver sheet in a Hitachi colour video printer VY-100A.

The receiver sheet was separated from the dye-donor element and the maximum colour density (Dmax) of the recorded dye image on the receiver sheet was measured in transmission by means of a Macbeth densitometer RD919 in Status A mode.

The stability to light of the dyes was tested as follows. The receiver sheet carrying transferred dye was divided into 3 strips. The first strip was exposed for 5 h, the second for 15 h, and the third for 30 h to white light and ultraviolet radiation in a XENOTEST (trade name) type 50 apparatus of Hanau Quartzlampen GmbH, Hanau, W. Germany. The density was measured again and the loss in density in percent was derived.

These experiments and measurements were repeated for each of the dye/binder combinations identified in Table 9. The results obtained are listed therein.

TABLE 9

| Dye | Binder | mg dye/ mg binder | solvent | Dmax | % Density loss 5 h | 15 h | 30 h |
|---|---|---|---|---|---|---|---|
| V.02 | CAB | 50/50 | EMK | 140 | 11 | 55 | — |
| V.02 | CN | 50/20 | EMK | 157 | 10 | 50 | — |
| V.03 | CAB | 50/50 | EMK | 167 | 9 | 62 | — |
| V.03 | CN | 50/20 | EMK | 174 | 1 | 62 | — |
| V.04 | CAB | 50/50 | EMK | 125 | 6 | 37 | — |
| V.04 | CN | 50/20 | EMK | 151 | 6 | 38 | — |
| V.05 | CAB | 50/50 | EMK | 160 | 7 | 46 | — |
| V.05 | CN | 50/20 | EMK | 181 | 3 | 40 | — |
| V.06 | CAB | 50/50 | EMK | 162 | 1 | 33 | — |
| V.06 | CN | 50/20 | EMK | 174 | 7 | 42 | — |
| V.07 | CAB | 50/50 | EMK | 169 | 22 | 61 | — |
| V.07 | CN | 50/20 | EMK | 203 | 21 | 61 | — |
| V.08 | CAB | 50/50 | EMK | 151 | 5 | 28 | 67 |
| V.08 | CN | 50/20 | EMK | 192 | 1 | 26 | 64 |
| V.09 | CAB | 50/50 | EMK | 70 | 91 | — | — |
| V.09 | CN | 50/20 | EMK | 138 | 89 | — | — |
| V.12 | CAB | 50/50 | EMK | 116 | 54 | — | — |
| V.12 | CN | 50/20 | EMK | 140 | 45 | — | — |
| V.14 | CAB | 50/50 | EMK | 116 | 65 | — | — |
| V.14 | CN | 50/20 | EMK | 117 | 62 | — | — |
| V.15 | CAB | 50/50 | EMK | 146 | 84 | — | — |
| V.15 | CN | 50/20 | EMK | 124 | 80 | — | — |
| V.17 | CAB | 50/50 | EMK | 134 | 92 | — | — |
| V.17 | CN | 50/20 | EMK | 148 | 92 | — | — |
| V.18 | CAB | 50/50 | EMK | 143 | 85 | — | — |
| V.18 | CN | 50/20 | EMK | 179 | 85 | — | — |
| V.19 | CAB | 50/50 | EMK | 140 | 88 | — | — |
| V.19 | CN | 50/20 | EMK | 150 | 88 | — | — |
| V.20 | CAB | 50/50 | EMK | 176 | 87 | — | — |
| V.20 | CN | 50/20 | EMK | 242 | 90 | — | — |
| V.21 | CAB | 50/50 | EMK | 168 | 91 | — | — |
| V.21 | CN | 50/20 | EMK | 203 | 90 | — | — |
| V.22 | CAB | 50/50 | EMK | 170 | 28 | 76 | — |
| V.22 | CN | 50/20 | EMK | 204 | 12 | 72 | — |

TABLE 9-continued

| Dye | Binder | mg dye/ mg binder | solvent | Dmax | % Density loss 5 h | 15 h | 30 h |
|---|---|---|---|---|---|---|---|
| V.23 | CAB | 50/50 | EMK | 152 | 52 | — | — |
| V.23 | CN | 50/20 | EMK | 200 | 34 | 82 | — |
| V.24 | CAB | 50/50 | EMK | 188 | 90 | — | — |
| V.24 | CN | 50/20 | EMK | 234 | 89 | — | — |

EMK stands for ethyl methyl ketone

CAB stands for cellulose acetate butyrate having an acetyl content of 29.5% and a butyryl content of 17% (Tg 161° C.; melting range: 230-240° C.)

CN stands for cellulose nitrate

I claim:

1. Dye-donor element for use according to thermal dye transfer methods, said element comprising a support having thereon a dye/binder layer comprising a dye carried by a polymeric binder resin, wherein said dye corresponds to the following general formula I:

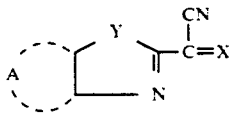

(I)

wherein:

A represents the atoms necessary to complete an aromatic or heteroaromatic ring system, Y stands for O, S, or $NR^1$, X stands for N-Ar, N-Het, N-N=Het, or $CR^2R^3$, $R^1$ stands for hydrogen, an alkyl group, a cycloalkyl group, an aryl group, $—SO_2R^4$, $—COR^4$, $—CSR^4$, or $—POR^4R^5$, Ar represents an aromatic nucleus, which is substituted in para-position with a substituent chosen from the group consisting of an amino group, an alkyloxy group, an aryloxy group, an alkylthio group, an arylthio group, hydroxy, and mercapto, and which aromatic nucleus may also be substituted in other positions with an alkyl group, an aryl group, or an acylamido group, Het represents a heterocyclic ring, $R^2$ and $R^3$ each independently represent hydrogen, an alkyl group, a cycloalkyl group, an aryl group, an alkenyl group, an alkynyl group, a heterocyclic ring, cyano, a halogen atom, $—SO_2R^4$, $—COR^4$, $—CSR^4$, or $—POR^4R^5$, or $R^2$ and $R^3$ together with the carbon atom to which they are attached represent the atoms necessary to complete a ring system including a heterocyclic ring system, and $R^4$ and $R^5$ each independently represent an alkyl group, a cycloalkyl group, an aryl group, an alkenyl group, an aralkyl group, an alkyloxy group, an aryloxy group, an alkylthio group, an arylthio group, an amino group, or a heterocyclic ring, or $R^4$ and $R^5$ together with the phosphor atom to which they are attached represent the atoms necessary to complete a 5- or 6-membered ring system.

2. A dye-donor element according to claim 1, wherein said dye corresponds to the following general formula II:

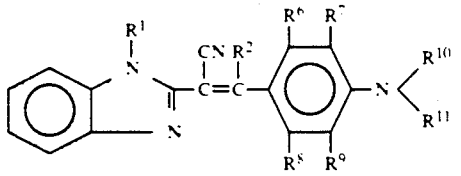

(II)

wherein:

$R^1$ stands for hydrogen, an alkyl group, a cycloalkyl group, an aryl group, $—SO_2R^4$, $—COR^4$, $—CSR^4$, or $—POR^4R^5$, $R^2$ stands for hydrogen, an alkyl group, a cycloalkyl group, an aryl group, an alkenyl group, an alkynyl group, a heterocyclic ring, cyano, a halogen atom, $—SO_2R^4$, $—COR^4$, $—CSR^4$, or $—POR^4R^5$, $R^4$ and $R^5$ each independently represent an alkyl group, a cycloalkyl group, an aryl group, an alkenyl group, an aralkyl group, an alkyloxy group, an aryloxy group, an alkylthio group, an arylthio group, an amino group, or a heterocyclic ring, or $R^4$ and $R^5$ together with the phosphor atom to which they are attached represent the atoms necessary to complete a 5- or 6-membered ring system, $R^6$, $R^7$, $R^8$, and $R^9$ each independently represent hydrogen, an alkyl group, a cycloalkyl group, an aryl group, an alkyloxy group, an aryloxy group, a carbamoyl group, a sulphamoyl group, hydroxy, a halogen atom, $—NH—CO_2-R^{12}$, $—NH—CO—R^{12}$, $—O—SO_2—R^{12}$, or $—O—CO—R^{12}$, $R^{10}$ and $R^{11}$ each independently represent hydrogen, an alkyl group, a cycloalkyl group, an aryl group, a heterocyclic group, or $R^{10}$ and $R^{11}$ together represent the atoms necessary to complete a heterocyclic group, or $R^{10}$ and/or $R^{10}$ together with $R^7$ and/or $R^9$ represent the atoms necessary to complete a heterocyclic group fused on on the benzene ring, and $R^{12}$ stands for an alkyl group, a cycloalkyl group, an aryl group, an alkenyl group, an aralkyl group, an alkyloxy group, an aryloxy group, an alkylthio group, an arylthio group, an amino group, or a heterocyclic ring.

3. A dye-donor element according to claim 1, wherein said dye corresponds to the following general formula III:

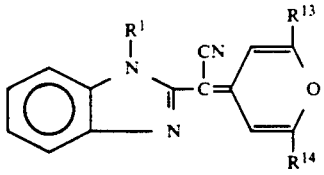

(III)

wherein:

$R^1$ stands for hydrogen, an alkyl group, a cycloalkyl group, an aryl group, $—SO_2R^4$, $—COR^4$, $—CSR^4$, or $—POR^4R^5$, $R^4$ and $R^5$ each independently represent an alkyl group, a cycloalkyl group, an aryl group, an alkenyl group, an aralkyl group, an alkyloxy group, an aryloxy group, an alkylthio group, an arylthio group, an amino group, or a heterocyclic ring, or $R^4$ and $R^5$ together with the phosphor atom to which they are attached represent the atoms necessary to complete a 5- or 6-membered ring system, $R^{13}$ and $R^{14}$ each independently represent hydrogen, an alkyl group, or an aryl group.

4. A dye-donor element according to claim 1, wherein said dye corresponds to the following general formula IV:

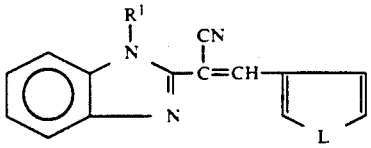

(IV)

wherein:

$R^1$ stands for hydrogen, on alkyl group, a cycloalkyl group, an aryl group, $—SO_2R^4$, $—COR^4$, $—CSR^4$, or $—POR^4R^5$, $R^4$ and $R^5$ each independently represent an alkyl group, a cycloalkyl group, an aryl group, an alkenyl group, an aralkyl group, an alkyloxy group, an aryloxy group, an alkylthio group, an arylthio group, an amino group, or a heterocyclic ring, or $R^4$ and $R^5$ together with the phosphor atom to which they are attached represent the atoms necessary to complete a 5- or 6-membered ring system, L stands for O, S, or $NR^{15}$, and $R^{15}$ stands for hydrogen, an alkyl group, a cycloalkyl group, an aryl group, $—SO_2R^{16}$, $—COR^{16}$, $—CSR^{16}$, or $—POR^{16}R^{17}$, $R^{16}$ and $R^{17}$ each independently representing an alkyl group, a cycloalkyl group, an aryl group, an alkenyl group, an aralkyl group, an alkyloxy group, an aryloxy group, an alkylthio group, an arylthio group, an amino group, or a heterocyclic ring, or $R^{16}$ and $R^{17}$ together with the phosphor atom to which they are attached represent the atoms necessary to complete a 5- or 6-membered ring system.

5. A dye-donor element according to claim 1, wherein said dye corresponds to the following general formula V:

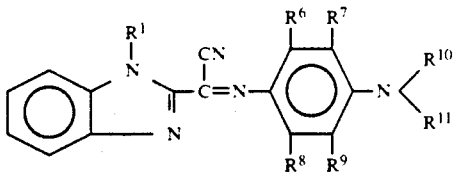

(V)

wherein: p1 $R^1$ stands for hydrogen, on alkyl group, a cycloalkyl group, an aryl group, $—SO_2R^4$, $—COR^4$, $—CSR^4$, or $—POR^4R^5$, $R^4$ and $R^5$ each independently represent an alkyl group, a cycloalkyl group, an aryl group, an alkenyl group, an aralkyl group, an alkyloxy group, an aryloxy group, an alkylthio group, an arylthio group, an amino group, or a heterocyclic ring, or $R^4$ and $R^5$ together with the phosphor atom to which they are attached represent the atoms necessary to complete a 5- or 6-membered ring system, $R^6$, $R^7$, $R^8$, $R^9$, $R^{10}$, and $R^{11}$ each independently represent hydrogen, an alkyl group, a cycloalkyl group, an aryl group, an alkyloxy group, an aryloxy group, a carbamoyl group, a sulphamoyl group, hydroxy, a halogen atom, —N-

H—$CO_2$—$R^{12}$, —NH—CO—$R^{12}$, —O—$SO_2$—$R^{12}$, or —O—CO—$R^{12}$, $R^{12}$ stands for an alkyl group, a cycloalkyl group, an aryl group, an alkenyl group, an aralkyl group, an alkyloxy group, an aryloxy group, an alkylthio group, an arylthio group, an amino group, or a heterocyclic ring.

6. A dye-donor element according to claim 1, wherein said dye corresponds to the following general formula VI:

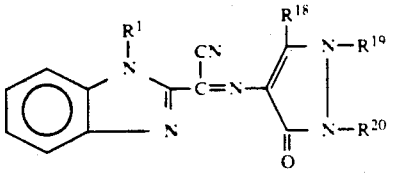

(VI)

wherein:

$R^1$ stands for hydrogen, on alkyl group, a cycloalkyl group, an aryl group, —$SO_2R^4$, —$COR^4$, —$CSR^4$, or —$POR^4R^5$, $R^4$ and $R^5$ each independently represent an alkyl group, a cycloalkyl group, an aryl group, an alkenyl group, an aralkyl group, an alkyloxy group, an aryloxy group, an alkylthio group, an arylthio group, an amino group, or a heterocyclic ring, or $R^4$ and $R^5$ together with the phosphor atom to which they are attached represent the atoms necessary to complete a 5- or 6-membered ring system, $R^{18}$ represents hydrogen or any substituent, $R^{19}$ represents hydrogen, an alkyl group, a cycloalkyl group, an aryl group, or a heterocyclic residue, and $R^{20}$ represents hydrogen, an alkyl group, a cycloalkyl group, an aryl group, acyl, or a heterocyclic residue.

7. A dye-donor element according to claim 1, wherein said dye corresponds to the following general formula VII:

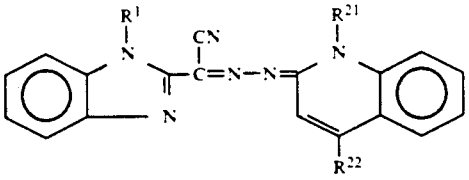

(VII)

wherein:

$R^1$ stands for hydrogen, on alkyl group, a cycloalkyl group, an aryl group, —$CO_2R^4$, —$COR^4$, —$CSR^4$, or —$POR^4R^5$, $R^4$ and $R^5$ each independently represent an alkyl group, a cycloalkyl group, an aryl group, an alkenyl group, an aralkyl group, an alkyloxy group, an aryloxy group, an alkylthio group, an arylthio group, an amino group, or a heterocyclic ring, or $R^4$ and $R^5$ together with the phosphor atom to which they are attached represent the atoms necessary to complete a 5- or 6-membered ring system, $R^{21}$ represents hydrogen, an alkyl group, a cycloalkyl group, an aryl group, or a heterocyclic residue, and $R^{22}$ represents hydrogen or any substituent.

8. A dye-donor element according to claim 1, wherein said dyes correspond to the following general formula VIII:

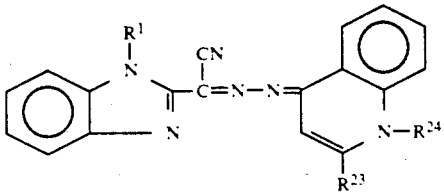

(VIII))

wherein:

$R^1$ stands for hydrogen, on alkyl group, a cycloalkyl group, an aryl group, —$SOR_2R^4$, —$COR^4$, —$CSR^4$, or —$POR^4R^5$, $R^4$ and $R^5$ each independently represent an alkyl group, a cycloalkyl group, an aryl group, an alkenyl group, an aralkyl group, an alkyloxy group, an aryloxy group, an alkylthio group, an arylthio group, an amino group, or a heterocyclic ring, or $R^4$ and $R^5$ together with the phosphor atom to which they are attached represent the atoms necessary to complete a 5- or 6-membered ring system, $R^{23}$ represents hydrogen or any substituent, and $R^{24}$ represents hydrogen, an alkyl group, a cycloalkyl group, a aryl group or a heterocyclic residue.

9. A dye-donor element according to claim 1, wherein the reverse side of said dye-donor element is coated with a slipping layer comprising a lubricating material.

10. A dye-donor element according to claim 1, wherein a dye barrier layer is provided between the support and the dye/binder layer.

11. A dye-donor element according to claim 1, wherein said support comprises polyethylene terephthalate.

12. A dye-donor element according to claim 1, wherein said element has sequential repeating areas of different dyes.

* * * * *